US010032582B2

(12) United States Patent
Uchii et al.

(10) Patent No.: US 10,032,582 B2
(45) Date of Patent: Jul. 24, 2018

(54) GAS CIRCUIT BREAKER

(71) Applicant: Kabushiki Kaisha Toshiba, Minato-ku (JP)

(72) Inventors: Toshiyuki Uchii, Yokohama (JP); Takeshi Shinkai, Yokohama (JP); Takanori Iijima, Yokohama (JP); Tadashi Mori, Yokohama (JP); Tadashi Koshizuka, Saitama (JP); Norimitsu Kato, Yokohama (JP); Hiroshi Furuta, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/665,364

(22) Filed: Mar. 23, 2015

(65) Prior Publication Data

US 2015/0194280 A1 Jul. 9, 2015

Related U.S. Application Data

(63) Continuation of application No. PCT/JP2013/005712, filed on Sep. 26, 2013.

(30) Foreign Application Priority Data

Sep. 28, 2012 (JP) ..... 2012-216894

(51) Int. Cl.
*H01H 33/91* (2006.01)
*H01H 33/88* (2006.01)
(Continued)

(52) U.S. Cl.
CPC ..... *H01H 33/91* (2013.01); *H01H 33/7023* (2013.01); *H01H 33/88* (2013.01);
(Continued)

(58) Field of Classification Search
CPC .... H01H 33/91; H01H 33/88; H01H 33/7023; H01H 33/04; H01H 33/72; H01H 33/73;
(Continued)

(56) References Cited

U.S. PATENT DOCUMENTS 4,450,330 A 5/1984 Zuckler
5,258,590 A 11/1993 Dufournet et al.
(Continued)

FOREIGN PATENT DOCUMENTS

CN 1069363 2/1993
CN 1069363 A 2/1993
(Continued)

OTHER PUBLICATIONS

Office Action dated Jun. 14, 2016 in Japanese Patent Application No. 2012-216894 (in English).
(Continued)

*Primary Examiner* — Renee S Luebke
*Assistant Examiner* — William Bolton
(74) *Attorney, Agent, or Firm* — Oblon, McClelland & Maier & Neustadt, L.L.P.

(57) ABSTRACT

A pair of fixed arc electrodes are arranged facing each other within a sealed container that is filled with arc-extinguishing gas 1. There are provided: a compression puffer chamber for accumulating pressurized gas that is obtained by elevating the pressure of the arc-extinguishing gas; and an insulated nozzle that directs the pressurized gas towards the arc discharge from the compression puffer chamber. A buffer chamber is provided, in which hot exhaust gas generated by the heat of the arc discharge is temporarily accumulated. A pressurized gas through-flow space is provided, communicating with the compression puffer chamber. In the pressurized gas through-flow space, an opening/closing section prevents inflow of hot exhaust gas by assuming a closed
(Continued)

condition during the earlier half of the current interruption period, and in the latter half of the current interruption period the opening/closing section 41 is opened to allow flow of pressurized gas.

15 Claims, 7 Drawing Sheets

(51) Int. Cl.
*H01H 33/70* (2006.01)
*H01H 33/90* (2006.01)
*H01H 9/34* (2006.01)
*H01H 33/12* (2006.01)

(52) U.S. Cl.
CPC ..... *H01H 9/342* (2013.01); *H01H 33/12* (2013.01); *H01H 33/903* (2013.01); *H01H 2033/888* (2013.01); *H01H 2033/906* (2013.01)

(58) Field of Classification Search
CPC ..... H01H 33/53; H01H 33/86; H01H 33/122; H01H 33/98; H01H 33/22; H01H 33/903; H01H 2033/888; H01H 85/43; H01H 33/12; H01H 33/70; H01H 33/56; H01H 33/90
USPC ..... 218/52, 53, 57, 59, 61, 63, 68, 93, 97, 218/11, 46
See application file for complete search history.

(56) References Cited

U.S. PATENT DOCUMENTS 5,844,189 A * 12/1998 Niemeyer ..... H01H 33/7015 218/29
5,905,243 A 5/1999 Zehnder et al.
5,977,502 A * 11/1999 Mizoguchi ..... H01H 33/901 218/43
6,163,001 A 12/2000 Zehnder et al.
6,515,248 B2 * 2/2003 Imamura ..... H01H 33/91 218/59
8,030,590 B2 * 10/2011 Yoshida ..... H01H 33/905 218/61
2008/0203061 A1 * 8/2008 Yoshida ..... H01H 33/905 218/61
2010/0224594 A1 * 9/2010 Uchii ..... H01H 33/7076 218/52
2010/0326958 A1 * 12/2010 Gregoire ..... H01H 33/905 218/46
2014/0069891 A1 * 3/2014 Otani ..... H01H 33/7046 218/46

FOREIGN PATENT DOCUMENTS

CN 101826414 9/2010
CN 101826414 A 9/2010
JP 55-53824 4/1980
JP 61-14444 1/1986
JP S61-14444 1/1986
JP 3-86536 U 9/1991
JP 5-198235 8/1993
JP 7-97466 B2 10/1995
JP 7-109744 B2 11/1995
JP 8-321233 A 12/1996
JP 2000-348580 12/2000
JP 2002-075148 3/2002
JP 2008-112633 5/2008
JP 2008-112633 A 5/2008
JP 4-989794 9/2010
JP 2010-211966 9/2010
JP 4855825 B2 1/2012
JP 4 989 794 8/2012

OTHER PUBLICATIONS

Office Action dated Mar. 9, 2016 in Chinese Patent Application No. 201380050316.5.
Supplementary European Search Report dated May 10, 2016 in European Patent Application No. 13841617.7.
Office Action issued in Chinese Patent Application No. 201380050316.5 dated Mar. 9, 2016.
Supplementary European Search Report issued in European Patent Application No. 13841617.7 dated May 10, 2016.
Extended Search Report dated Feb. 28, 2017 in European Patent Application No. 16201307.2.
Office Action dated Oct. 18, 2016 in Japanese Patent Application No. 2012-216894 (with English translation).

* cited by examiner

GAS CIRCUIT BREAKER

CROSS REFERENCE TO RELATED APPLICATION

This is a Continuation of PCT Application No. PCT/JP2013/005712, filed on Sep. 26, 2013, which is based upon and claims the benefit of priority from the prior Japanese Patent Application No. 2012-216894, filed on Sep. 28, 2012, the entire contents of which are incorporated herein by reference.

FIELD

This embodiment of the present invention relates to a gas circuit breaker that aims to achieve improved circuit breaking performance without allowing the hot exhaust gas produced by the arc discharge to contribute to elevation of the pressure of the puffer chamber.

BACKGROUND

Typically in power systems, gas circuit breakers are employed to perform current switching, including in the case of excessive fault current. In the common puffer type of gas circuit breaker, the arc discharge is extinguished by directing arc-extinguishing gas onto the arc.

An example is to be found in issued Japanese Patent Number Tokko H 7-109744 (hereinafter referred to as Patent Reference 1). A specific description of such a puffer type gas circuit breaker is given below with reference to FIG. 6A, FIG. 6B, and FIG. 6C. FIG. 6A to FIG. 6C show a rotationally symmetrical shape whose axis of rotation is the center-line: FIG. 6A is the conducting condition; FIG. 6B is the earlier half of the current interruption action; and FIG. 6C is the latter half of the current interruption action.

As shown in FIG. 6A to FIG. 6C in a puffer type gas circuit breaker, there are provided a facing arc electrode 2 and a facing powered electrode 3; opposite to and on a concentric axis with these electrodes 2 and 3, there are arranged a movable arc electrode 4 and movable powered electrode 5 in a freely reciprocable manner. These electrodes 2 to 5 are accommodated in a sealed enclosure (not shown) that is filled with arc-extinguishing gas 1. As the arc-extinguishing gas 1, SF6 gas (sulfur hexafluoride gas), which is of excellent arc interruption performance (extinguishing performance) and electrical insulating performance, is usually employed; however, other media could also be employed.

The movable arc electrode 4 is mounted at the tip of a hollow drive rod 6; the movable powered electrode 5 is mounted at the tip of a puffer cylinder 9. Also, an insulated nozzle 8 is mounted on the inside of the movable powered electrode 5, at the tip of the puffer cylinder 9. This movable arc electrode 4, movable powered electrode 5, drive rod 6, insulated nozzle 8 and puffer cylinder 9 are integrally constituted. These integrally constituted parts are driven together with the movable-side electrodes 4, 5 and so will be referred to in common as a movable section. Also, a fixed piston 15 is freely slidably arranged in the puffer cylinder 9. The fixed piston 15 is fixed within the sealed container independently of the aforementioned movable section. An inlet hole 17 and inlet valve 19 are provided in the fixed piston 15.

A puffer chamber 22 is constituted by the space that is defined by the drive rod 6, puffer cylinder 9 and the sliding face 15*a* of the fixed cylinder 15. The puffer cylinder 9 and fixed piston constitute means for pressurizing the arc-extinguishing gas 1 in the puffer chamber 22 and the puffer chamber 22 constitutes a pressure-accumulation space in which the pressurized arc-extinguishing gas 1 is accumulated. The insulated nozzle 8 constitutes means for defining (rectifying) and directing (blasting) the flow of arc-extinguishing gas 1 from the puffer chamber 22 towards the arc discharge 7.

In a puffer-type gas circuit breaker constructed as above, in the closed condition, the facing arc electrode 2 and the movable arc electrode 4 are mutually connected and in current-conducting condition, and the facing powered electrode 3 and the movable powered electrode 5 are mutually connected and in current-conducting condition (see FIG. 6A). When current interruption action is executed from this closed condition, the movable arc electrode 4 and the movable powered electrode 5 are driven in the rightwards direction in FIG. 6A, FIG. 6B and FIG. 6C by the drive rod 6.

When, as the drive rod 6 is driven, the facing arc electrode 2 and the movable arc electrode 4 are separated, an arc discharge 7 is generated between these arc electrodes 2, 4. Also, accompanying the interruption action, the volume in the puffer chamber 22 is reduced by mutual approach of the puffer cylinder 9 and the fixed piston 15, causing the arc-extinguishing gas 1 in the chamber to be mechanically compressed (see FIG. 6B). The insulated nozzle 8 shapes (rectifies) the flow of arc-extinguishing gas 1 that is compressed in the puffer chamber 22 and directs this flow onto the arc discharge 7 as a gas blast 21, thereby extinguishing the arc discharge 7 (see FIG. 6C).

Also, if the puffer type gas circuit breaker performs a closure action, at the time-point where the pressure of the puffer chamber 22 becomes lower than the filling pressure of the arc-extinguishing gas 1, the inlet valve 19 provided in the fixed piston 15 is operated, thereby opening the inlet hole 17, so as to replenish intake of air-extinguishing gas 1 into the puffer chamber 22. In this way, the arc-extinguishing gas 1 in the puffer chamber 22 can be rapidly replenished even during closure action immediately after current interruption. Consequently, even if the puffer-type gas circuit breaker performs a high-speed re-closure action, the arc discharge 7 can be reliably extinguished by maintaining ample gas flow rate of the gas blast 21 in the second interruption action.

However, when the puffer-type gas circuit breaker interrupts a large current, the pressure of the arc-extinguishing gas 1 in the puffer chamber 22 needs to be raised to a blasting pressure that is fully sufficient to extinguish the arc discharge 7. In these circumstances, if it is attempted to increase the blasting pressure of the arc-extinguishing gas 1 simply by using a powerful drive mechanism, because of the need to install such a powerful drive mechanism, mechanical vibration when performing the interruption action is increased and costs are also raised.

In a puffer-type gas circuit breaker, there has therefore been a demand to reduce the drive operating force while maintaining a powerful blasting pressure. In order to meet this demand, an action of elevating the pressure of the puffer chamber 22 by introduction of high-temperature hot exhaust gas 20 generated by the arc discharge 7 i.e. a so-called self-pressurizing action is utilized. A self-pressurizing action in a puffer-type gas circuit breaker is described below with reference to FIG. 6B.

Specifically, as shown in FIG. 6B, in the earlier half of the current interruption action, the facing arc electrode 2 is not fully extracted from the narrowest flow path section (throat) of the insulated nozzle 8, with the result that hot exhaust gas 20 from the periphery of the arc discharge 7 flows into the interior of the puffer chamber 22. As a result, without needing to employ a powerful drive mechanism that provides a large drive operating force, the internal pressure of the puffer chamber 22 becomes high so the blasting pressure of the gas blast 21 is maintained and a reduction in the drive operating force can be achieved.

Also, in the case of a gas circuit breaker of the type called a series puffer type gas circuit breaker (for example as disclosed in issued Japanese Patent (Tokko H 7-97466 (hereinafter referred to as Patent Reference 2), further reduction in the drive operating force can be achieved by restricting the space affected by the self-pressurizing action. As shown in FIG. 7A, FIG. 7B and FIG. 7C, a series puffer type gas circuit breaker is characterized in that the puffer chamber is divided into two spaces by a partition plate 10. It should be noted that, in FIG. 7A, FIG. 7B and FIG. 7C, members that are the same as in the puffer-type gas circuit breaker shown in FIG. 6A, FIG. 6B, and FIG. 6C are given the same reference numerals and further description thereof is dispensed with. FIG. 7A to FIG. 7C likewise show a rotationally symmetrical shape whose axis of rotation is the centerline: FIG. 7A is the conducting condition; FIG. 7B is the earlier half of the current interruption action; and FIG. 7C is the latter half of the current interruption action.

Of these two spaces into which the puffer chamber is divided, the space into which the hot exhaust gas 20 is introduced from the space where the arc discharge 7 is generated is designated as a heating puffer chamber 11 and the space where the fixed piston 15 is freely and slidably arranged on the opposite side from this is designated as a compression puffer chamber 12. A communication aperture 13 is provided in the partition plate 10 that partitions the heating puffer chamber 11 and the compression puffer chamber 12, and a non-return valve 14 is mounted therein. Also, an exhaust hole 16 and pressure relief valve 18 are arranged in the fixed piston 15. The pressure relief valve 18 is arranged to open when the pressure of the compression puffer chamber 12 rises to a predetermined set value.

In a series puffer type gas circuit breaker constructed as above, in the earlier half of the current interruption action, as shown in FIG. 7B, the facing arc electrode 2 does not completely pass through the narrowest flow path section (throat) of the insulated nozzle 8, so the hot exhaust gas 20 produced by the arc discharge 7 flows into the heating puffer chamber 11. Consequently, the pressure of the heating puffer chamber 11 is greatly elevated by the self-pressurizing action achieved by the arc heating, so a pressure that is ample for extinguishing the arc discharge 7 can be obtained and the high pressure necessary for large current interruption can be created within the enclosed space of the heating puffer chamber 11.

Thereupon, whilst the pressure of the heating puffer chamber 11 is high due to the pressure of the compression puffer chamber 12, the non-return valve 14 is passively closed by this pressure difference. Consequently, even though the pressure of the heating puffer chamber 11 is elevated, there is no possibility of the effect thereof reaching the compression puffer chamber 12, so there is no possibility of the drive force acting on the fixed piston 15, that slides through the compression puffer chamber 12, being increased. As the current interruption action proceeds, the pressure in the compression puffer chamber 12 becomes high, and when the pressure of the compression puffer chamber 12 exceeds that of the heating puffer chamber 11, the non-return valve 14 opens, allowing the arc-extinguishing gas 1 to flow into the heating puffer chamber 11 from the compression puffer chamber 12 and thus making it possible to blast the air discharge 7 with a gas blast 21 having the gas blast quantity and pressure required for current interruption.

It should be noted that the pressure relief valve 18 opens as soon as the pressure of the compression puffer chamber 12 rises to a preset value. Consequently, the pressure of the compression puffer chamber 12 is always kept below the set value i.e. only a pressure restricted by the pressure relief valve 18 is applied to the fixed piston 15. There is therefore no possibility of the pressure within the compression puffer chamber 12 becoming an excessively high pressure, which would apply a large load to the drive mechanism.

Also, in the case of interrupting a small current in a series puffer type gas circuit breaker, the self-pressurizing action produced by arc heating is small, so pressure elevation of the heating puffer chamber 11 by this action cannot be expected. Consequently, the pressure of the compression puffer chamber 12 is relatively higher than the pressure of the heating puffer chamber 11, so the non-return valve 14 is in an open condition. As a result, the arc-extinguishing gas 1 flows into the heating puffer chamber 11 from the compression puffer chamber 12 due to the compressive action of the fixed piston 15, so the necessary blasting pressure for current interruption can be guaranteed.

However, a solution to the following problems of a conventional gas circuit breaker was still awaited.

(A) Temperature of the Gas Blast

In a conventional gas circuit breaker, the hot exhaust gas 20 from the arc is introduced into the puffer chamber 22 or heating puffer chamber 11, so a gas blast 21 that is heated to a high temperature is directed onto the arc discharge 7. Consequently, the efficiency of cooling the arc discharge 7 is lowered, which may lower the circuit breaking performance.

(B) Effect of the Temperature of the Gas Blast on Durability and Maintenance

Also, the temperature in the vicinity of the arc discharge 7 is raised by the high-temperature gas blast 21 being blown onto the arc discharge 7. As a result, the arc electrodes 2, 4 and insulated nozzle 8 tend to be degraded by exposure to high temperature, giving rise to a need for frequent maintenance. This is contrary to user needs for improved durability and reduced maintenance.

(C) Current Interruption Time

In addition, it takes a certain amount of time to raise the pressure in the heating puffer chamber 11 and in the puffer chamber 22. The time required until current interruption is completed may thereby be prolonged. Since a gas circuit breaker is an appliance for rapidly interrupting excess fault current in a power system, from the point of view of the basic function of a gas circuit breaker, it is always demanded that the time that elapses before current interruption is completed should be as short as possible.

(D) Drive Operating Force

Also, in order to reduce the drive operating force in a gas circuit breaker, it is important to simplify the construction and reduce weight. For example, in the case of a series puffer type gas circuit breaker in which the puffer chamber is divided into two, since ancillary components such as the partition plate 10 and/or non-return valve 14 are indispensable, the construction tends to become more complicated and the weight of the moving parts tends to be increased. When the weight of the moving parts increases, a strong drive operating force is inevitably necessitated. In other words, in a conventional series puffer type gas circuit breaker, simplification of the construction is sought in order to contribute to reduction in weight of the moving parts.

(E) Direction of the Gas Flow

Furthermore, in a puffer type gas circuit breaker in which a gas blast 21 is directed onto an arc discharge 7, stabilization of the flow of arc-extinguishing gas 1 within the appliance is considered vital. In particular, in a series puffer type gas circuit breaker the flow of arc-extinguishing gas tends to become unstable, and improvement in this regard is desired.

Specifically, in a series puffer type gas circuit breaker, arc-extinguishing gas 1 that flows out from the compression puffer chamber 12 flows into the arc discharge 7 within the insulated nozzle 8 after passing through the heating puffer chamber 11. Consequently, the flow path area of the arc-extinguishing gas 1 from the compression puffer chamber 12 through the communication aperture 13 of the partition plate 10 until it reaches the arc discharge 7 is greatly expanded in the region of the heating puffer chamber 11 so smooth flow of arc-extinguishing gas 1 is impeded.

Furthermore, in the case of interrupting a small current, the pressure of the heating puffer chamber 11 is low, since the thermal energy of the hot exhaust gas 20 is small; the arc-extinguishing gas 1 that flows in from the compression puffer chamber 12 is thus consumed in elevating the pressure of the heating puffer chamber 11 until it reaches the same pressure as that of the compression puffer chamber 12. The pressure of the arc-extinguishing gas 1 when directed towards the arc discharge 7 was therefore very small, making it difficult to achieve superior interruption performance.

Also, in a series puffer type gas circuit breaker, when performing interruption in the large current region, the gas blast 21 is directed onto the arc discharge 7 solely by the pressure of the heating puffer chamber 11 whereas, when performing interruption in the small current region, the arc-extinguishing gas 1 from the compression puffer chamber 12 is directed onto the arc discharge 7. In other words, in the case of a series puffer type gas circuit breaker, the space supplying the arc-extinguishing gas 1 is changed over between the heating puffer chamber 11 and the compression puffer chamber 12 in accordance with the magnitude of the current that is to be interrupted.

The above changeover is effected by passive opening/closure of the non-return valve 14 in response to the pressure difference of the heating puffer chamber 11 and the compression puffer chamber 12. Consequently, in the intermediate current region, when the pressure difference between the heating puffer chamber 11 and the compression puffer chamber 12 is small, changeover of the source of supply of the arc-extinguishing gas 1 becomes indeterminate, and the operation of the non-return valve 14 thus becomes unstable. Thus, in spite of this action of the non-return valve 14, there was a risk that the flow of arc-extinguishing gas 1 would become unstable.

(F) Interruption Performance in the Case of High-Speed Re-Closure Action

Furthermore, while it is of course desirable that a gas circuit breaker should have excellent interruption performance in the case of high-speed re-closure action, there is the problem that poor interruption performance in high-speed re-closure action is sometimes experienced with series puffer type gas circuit breakers. Specifically, the inlet hole 17 and inlet valve 19 are formed in the fixed piston 15, so, during closure operation, albeit the arc-extinguishing gas 1 is replenished by intake therefrom in the case of the compression puffer chamber 12, in the case of the heating puffer chamber 11, no such intake replenishment of arc-extinguishing gas 1 is possible. As a result, the interior of the heating puffer chamber 11 immediately after a first occasion of current interruption is filled with arc-extinguishing gas 1 that has been heated to a high temperature by the high-temperature arc discharge 7.

Consequently, if a second current interruption is performed in a condition in which the gas within the heating puffer chamber 11 has not been replaced by arc-extinguishing gas 1 of low temperature and high density, high-temperature, low-density arc-extinguishing gas 1 will be directed onto the arc discharge 7. The arc-extinguishing performance and electrical insulation performance of high-temperature, low-density gas is poor. There was therefore concern that the interruption performance of a series puffer type gas circuit breaker would be degraded in the case of high-speed re-closure action.

The gas circuit breaker according to the present embodiment was proposed in order to solve all the problems described above. Specifically, an object of the gas circuit breaker according to this embodiment is to provide a gas circuit breaker wherein: the temperature of the gas blast is lowered; durability is improved and maintenance is reduced; the current interruption time is shortened; and the drive operating force is reduced; and, in addition, in which the flow of arc-extinguishing gas is stabilized, and, furthermore, the interruption performance during high-speed re-closure action is improved.

In order to achieve the above object, the following construction is provided according to the present invention. Specifically, a gas circuit breaker is characterized in that it is constituted by oppositely arranging a pair of arc electrodes in a sealed container filled with arc-extinguishing gas, said arc electrodes being constructed so that they are capable of electrical conduction and are capable of generating arc discharge between these two electrodes during current interruption, and is provided with:

a pressurizing means in order to direct arc-extinguishing gas onto said arc discharge, that generates pressurized gas by elevating the pressure of said arc-extinguishing gas;

a pressure-accumulation space that accumulates said pressurized gas; and a flow-shaping means that directs said pressurized gas toward said arc discharge from said pressure-accumulation space;

said gas circuit breaker comprising:

a hot exhaust gas accumulation space that is provided in order to temporarily accumulate hot exhaust gas generated by the heat of said arc discharge; comprising a pressurized gas through-flow space communicating with said pressure-accumulation space, and an opening/closing section that can be freely opened/closed, provided in order to produce a closed condition or open condition of said pressure-accumulation space;

wherein said opening/closing section is constituted so that it is in a closed condition in the earlier half of the current interruption period, in which it prevents inflow of said hot exhaust gas into said pressure-accumulation space, and is in an open condition in the latter half of the current interruption period, so as to direct said pressurized gas in said pressure-accumulation space onto said arc discharge.

DETAILED DESCRIPTION

Embodiments

(1) First Embodiment

Construction

Figure 1A:
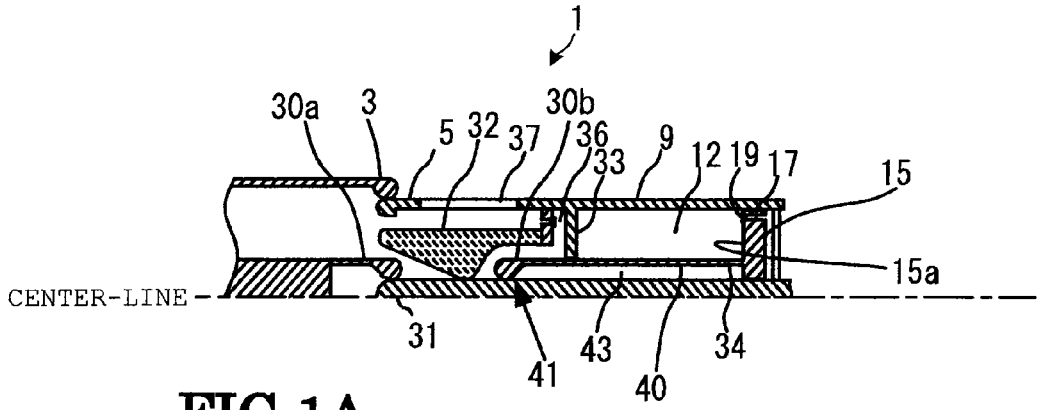
FIG. 1A, FIG. 1B and FIG. 1C are cross-sectional views showing the construction of a first embodiment.
Figure 1B:
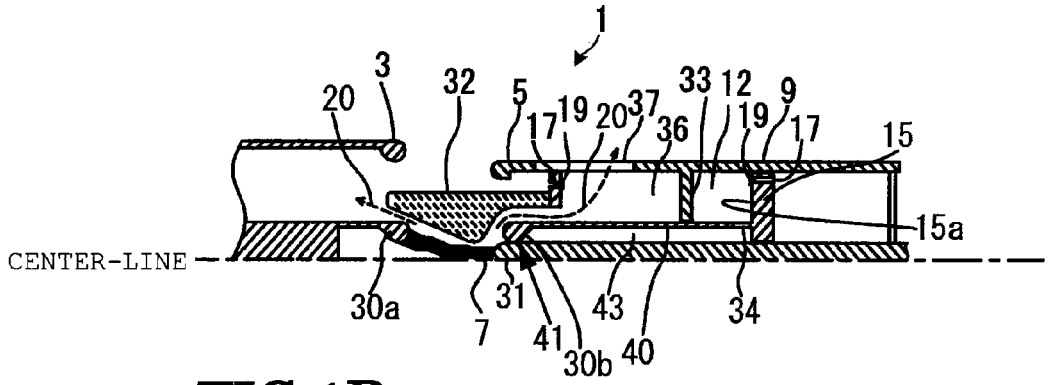
Figure 1C:
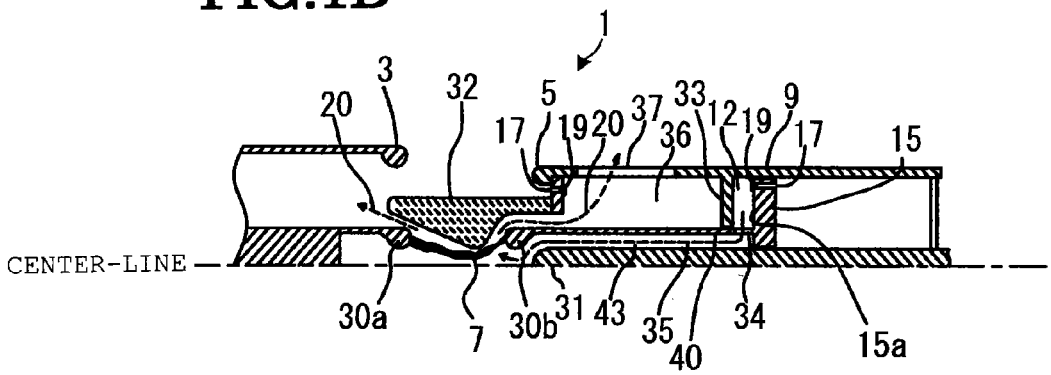

The construction of a first embodiment of the invention is described below with reference to FIG. 1A, FIG. 1B, and FIG. 1C. It should be noted that, since the main construction of the first embodiment is similar to that of the conventional gas circuit breaker shown in FIG. 6A, FIG. 6B, FIG. 6C and FIG. 7A, FIG. 7B, FIG. 7C, members that are the same as in the case of the conventional gas circuit breaker shown in FIG. 6A, FIG. 6B, FIG. 6C and FIG. 7A, FIG. 7B, FIG. 7C are given the same reference symbols and further description is dispensed with. FIG. 1A to FIG. 1C, like FIG. 6A to FIG. 6C and FIG. 7A to FIG. 7C, show shapes that are rotationally symmetrical about the central axis as axis of rotation, FIG. 1A being the conducting condition, FIG. 1B being the condition in the earlier half of the current interruption action and FIG. 1C being the condition in the latter half of the current interruption action.

In the first embodiment, a fixed arc electrode 30*a* is provided in place of the facing arc electrode 2; a fixed arc electrode 30*b* is arranged opposite to this fixed arc electrode 30*a*. The fixed arc electrode 30*b* is provided at the tip of a cylindrical member 40 that extends leftward in the Figure from a sliding face 15*a* of the fixed piston 15. In other words, the fixed arc electrode 30*b*, the sliding face 15*a* of the fixed piston 15, and the cylindrical member 14 are integrally provided.

Rather than being members that are included in the movable section including the movable powered electrode 5 and the puffer cylinder 9, the pair of fixed arc electrodes 30*a*, 30*b* are members that are fixed within a sealed container (not shown). Also, the pressure within the sealed container during ordinary operation is a single pressure in each part thereof, for example the filling pressure of the arc-extinguishing gas 1.

Within the fixed arc electrodes 30*a*, 30*b*, the rod-shaped trigger electrode 31, which is of smaller diameter than the fixed arc electrodes 30*a*, 30*b*, is arranged so as to move between the electrodes while being in contact with the fixed arc electrodes 30*a*, 30*b*. The trigger electrode 31 is in contact with the fixed arc electrodes 30*a*, 30*b* and implements a conductive condition by short-circuiting these two fixed arc electrodes 30*a*, 30*b*. Also, in the event of current interruption, an arc discharge 7 is generated between the trigger electrode 31 and the fixed arc electrode 30*a*, but this arc discharge 7 ultimately migrates away from the trigger electrode 31 to the aforementioned arc electrode 30*b*.

An insulated nozzle 32 is arranged so as to surround the trigger electrode 31. The insulated nozzle 32 is arranged so that it can be freely brought into contact with or separated from the surface of the trigger electrode 31. Like the fixed arc electrodes 30*a*, 30*b*, the insulated nozzle 32 is not integrally incorporated in the movable section including the movable powered electrode 5 and puffer cylinder 9, but, instead, is fixed in a sealed container (not shown) independent from the movable section.

A movable piston 33 that is integrally fixed to the puffer cylinder 9 is arranged within the puffer cylinder 9. The bottom end section of the movable piston 33 slides over the outer surface of the cylindrical member 40. A buffer chamber 36 is formed on the left-hand side of the movable piston 33 and a compression puffer chamber 12 is formed on the right-hand side of the movable piston 33.

The buffer chamber 36 is constituted by the space enclosed by the base of the insulated nozzle 32, the puffer cylinder 9, the movable piston 33 and the cylindrical member 40. The buffer chamber 36 is a hot exhaust gas accumulation space for temporarily accumulating (buffering) the hot exhaust gas 20 that is generated by the heat of the arc discharge. Also, an exhaust hole 37 is provided in the puffer cylinder 9 adjacent to the movable powered electrode 5.

Also, the compression puffer chamber 12 on the right-hand side of the movable piston 33 is constituted by the space enclosed by the movable piston 33, puffer cylinder 9, the sliding face 15*a* of the fixed piston 15, and the cylindrical member 40. In the compression puffer chamber 12, the arc-extinguishing gas 1 is mechanically compressed by the movable piston 33 as the current interruption action i.e. the electrode-opening action proceeds, thereby generating pressurized gas 35 (shown in FIG. 10).

However, a blowout hole 34 is provided in the base section of the cylindrical member 40. The arrangement is such that the pressurized gas 35 in the compression puffer chamber 12 passes through this blowout hole 34 and flows between the trigger electrode 31 and the cylindrical member 40, before being directed onto the arc discharge 7. The space between the trigger electrode 31 and the cylindrical member 40 whereby the pressurized gas 35 flows through the blowout hole 34 is designated as a pressurized gas through-flow space 43.

The fixed arc electrode 30*b* is arranged at the end of this pressurized gas through-flow space 43. An opening/closing section 41 is then formed by the contact portions of the fixed arc electrode 30*b* and the trigger electrode 31. The opening/closing section 41 is constituted so as to be capable of being freely opened/closed in order to put the pressure accumulation space constituted by the compression puffer chamber 12 into a closed condition or open condition. In the earlier half of the current interruption action, the opening/closing section 41 is in a closed condition, preventing inflow of hot exhaust gas 20 to the pressurized gas through-flow space 43 and buffer chamber 36; but in the latter half of the current interruption action, it is in an open condition, so as to direct the pressurized gas 20 in the puffer chamber 12 onto the arc discharge 7.

In the compression puffer chamber 12 and the buffer chamber 35, there are provided an inlet hole 17 and inlet valve 19. The inlet valve 19 is constituted so as to replenish intake of arc-extinguishing gas 1 into the chambers 12 and 36 only when the pressure within the chambers 12, 36 falls below the filling pressure in the sealed container.

(Closed Condition)

In the closed condition of the first embodiment, the fixed arc electrode 30*a* and the fixed arc electrode 30*b* are in a separated condition and the conductive condition is achieved (condition of FIG. 1A) by the trigger electrode 31 short-circuiting the fixed arc electrodes 30*a*, 30*b*.

(Current Interruption Action)

When the first embodiment performs the current interruption action, the puffer cylinder 9 is driven in the electrode-opening direction i.e. the rightwards direction in FIG. 1A, FIG. 1B and FIG. 1C by a drive operating mechanism (not shown), and the buffer chamber 36 on the left-hand side of the movable piston 33 is expanded in volume together with this electrode-opening drive. Consequently, the buffer chamber 36 sucks in the hot exhaust gas 20 generated by the arc discharge 7 and temporarily accumulates (buffers) this hot exhaust gas; by the rise in the internal pressure of the buffer chamber 36, the hot exhaust gas 20 is discharged as appropriate from the exhaust hole 37, which is provided in the puffer cylinder 9. Also, the arc-extinguishing gas 1 within the compression puffer chamber 12 is pressurized by being compressed by the movable piston 33, by the electrode-opening drive of the puffer cylinder 9 in the right-hand direction in FIG. 1A to FIG. 1C, thereby generating pressurized gas 35.

(Condition of FIG. 1B and FIG. 1C).

When, linked to the movement of the puffer cylinder 9, the trigger electrode 31 is also driven in the contacts-opening direction i.e. the rightwards direction in FIG. 1A, FIG. 1B and FIG. 1C and the trigger electrode 31 is thereby separated from the left-hand side fixed arc electrode 30*a* in FIG. 1A, FIG. 1B, FIG. 1C, arc discharge 7 between the two electrodes 31 and 30*a* is ignited (condition of FIG. 1B). The period for which arc discharge 7 to the trigger electrode 31 is ignited is only the initial period of the interruption process, until the arc discharge 7 is migrated to the fixed arc electrode 30*b*. At this time-point, the fixed arc electrode 30*b* and the trigger electrode 31 are in contact, so the opening/closing section 41 is in a closed condition: the pressurized gas through-flow space 43 is thus in a sealed condition (condition in FIG. 1A and FIG. 1B, with the exception of the unavoidable gap that must be provided to allow mutual sliding action of the electrodes 30*b*, 31.

That is to say, the opening/closing section 41 is in closed condition because of the contact of the fixed arc electrode 30*b* and the trigger electrode 31, so communication of the pressurized gas through-flow space 43 and the space where the arc discharge 7 is generated is obstructed. In other words, by closing the opening/closing section 41, ingress of hot exhaust gas 20 into the pressurized gas through-flow space 43 is prevented. In this way it is ensured that, putting aside the operationally unavoidable gap between the electrodes 30*b* and 31, the hot exhaust gas 20 that underwent thermal expansion due to the heat of the arc discharge 7 cannot flow into the compression puffer chamber 12 through the pressurized gas through-flow space 43 and blowout hole 34.

When the fixed arc electrode 30*b* and the trigger electrode 31 are separated, the arc discharge 7 that is generated between the fixed arc electrode 30*a* and the trigger electrode 31 migrates from the trigger electrode 31 to the fixed arc electrode 30*b*, and arc discharge 7 is generated between the fixed arc electrodes 30*a* and 30*b* (condition of FIG. 1C).

When the fixed arc electrode 30*b* and the trigger electrode 31 separate, the opening/closing section 41 that prevented ingress of hot gas 20 into the pressurized gas through-flow space 43 assumes the open condition. In other words, the contact of the fixed electrode 30*b* and the trigger electrode 31 is released and the pressurized gas through-flow space 43 and the space where the arc discharge 7 is generated are put in communication. Consequently, the compression puffer chamber 12 and the space where the arc discharge 7 is generated are linked through the blowout hole 34 (condition of FIG. 1C).

In this way, the pressurized gas 35 in the compression chamber 12, that was compressed by the movable piston 33, is ejected from the inner side of the fixed arc electrode 30*b*, through the blowout hole 34 and the pressurized gas through-flow space 43. The insulated nozzle 32 then shapes the flow of the pressurized gas 35 before directing it forcibly onto the arc discharge 7, and can thereby extinguish the arc discharge 7. In this process, the pressurized gas 35 passing through the pressurized gas through-flow space 43 is injected into the vicinity of the end section of the gas discharge 7 nearer to the fixed arc electrode 30*b*, so the arc discharge 7 can be more reliably extinguished.

(Beneficial Effect)

The beneficial effect of the first embodiment described above is as follows.

(a) Lowering of the Temperature of the Gas Blast

The first embodiment has the characteristic feature that the self-pressurizing action produced by arc heating is not utilized. Consequently, rather than being thermally compressed by the hot exhaust gas 20, the pressurized gas 35 that is directed onto the arc discharge 7 can be low-temperature gas whose pressure is elevated solely by mechanical compression.

Although the possibility of influx of an extremely minute quantity of hot exhaust gas 20 into the compression puffer chamber 12 from the sliding gap between the fixed arc electrode 30*b* and the trigger electrode 31 cannot be denied, its effect is extremely slight. Consequently, the temperature of the pressurized gas 35 that is directed onto the arc discharge 7 is much lower than the temperature of the conventional gas blast 21 utilizing the self-pressurizing action. As a result, the cooling effect of directing the pressurized gas 35 onto the arc discharge 7 can be very greatly increased.

(b) Improved Durability and Reduced Maintenance

In this embodiment, the temperature in the vicinity of the arc discharge 7 is lowered by directing low-temperature pressurized gas 35 thereon. Consequently, deterioration of the fixed arc electrodes 30*a*, 30*b* and the insulated nozzle 32 produced by current interruption can be very greatly alleviated, improving durability. As a result, the frequency of maintenance of the fixed arc electrodes 30*a*, 30*b* and the insulated nozzle 32 can be reduced, making it possible to reduce the maintenance burden.

Also, since the arc electrodes 30*a*, 30*b*, which are fixed to the sealed container, do not affect the weight of the movable section, the fixed arc electrodes 30*a*, 30*b* can be made of large thickness without concerns regarding increased weight. Consequently, the durability of the arc electrodes 30*a*, 30*b* in regard to large-current arcs can be very greatly improved. Furthermore, if the arc electrodes 30*a*, 30*b* are made of large thickness, electric field concentration at the tips of the arc electrodes 30*a*, 30*b* when high voltage is applied across the electrode gap can be considerably alleviated.

The necessary electrode gap interval can therefore be reduced compared with a conventional gas circuit breaker. As a result, the length of the arc discharge 7 becomes shorter, and the electrical input power to the arc discharge 7 during current interruption becomes smaller. In the case of a gas circuit breaker that makes use of the self-pressurizing action of the arc heating, reduction of the electrical input power to the arc discharge is associated with lowering of the self-pressurizing action and is therefore undesirable from the point of view of current interruption performance.

However, since, in this embodiment, the self-pressurizing action of arc heating is not made use of, the reduction in electrical input power to the arc discharge 7 can have no effect in terms of the current interruption performance. The beneficial effect that a large contribution to improved thermal durability is obtained can therefore be achieved, albeit the fixed arc electrodes 30*a*, 30*b* are made thicker. A corresponding benefit is also obtained when the insulated nozzle 32 is made larger.

Incidentally, consideration has been given for example to a construction in which, in order to pressurize the arc-extinguishing gas 1 without utilizing an arc-heat self-pressurizing action, compressed gas is generated beforehand by a compressor in a high-pressure reserve tank and compressed gas is directed onto the arc discharge 7 by synchronized opening of circuit-breaking valves on current interruption. However, since this involves the addition of ancillary components such as the reserve tank, compressor and electromagnetic valves in order to achieve such a construction, this has the drawbacks of tending to increase the size and cost of the equipment, with adverse consequences in terms of maintenance.

In contrast, in the first embodiment, an extremely simple construction can be implemented, in which during normal operation the pressure in the sealed container is a single pressure, for example, the filling pressure of the arc-extinguishing gas 1 in all portions of the sealed container, and the necessary pressurized gas 35 is generated only in the current interruption stage. Consequently, with the first embodiment, equipment compactness and cost reduction can be achieved, enabling the workload involved in maintenance to be reduced.

(c) Shortening of the Current Interruption Time

As described above, when utilizing the self-pressurizing action of arc heating, a certain amount of time is required in order to pressurize the arc-extinguishing gas 1 in the puffer chamber to a pressure that is sufficiently high to achieve interruption. Consequently, in a conventional interruption system that employs the self-pressurizing action of arc heating, the time before current interruption is completed tends to be prolonged.

However, in this embodiment, a self-pressurizing action based on arc heating is not employed, so the pressure and flow rate of the pressurized gas 35 that is directed onto the arc discharge 7 can be kept constant irrespective of flow conditions. Also, the timing of the commencement of application of the blast of pressurized gas 35 is determined by the timing with which the tip of the trigger electrode 31 passes the fixed arc electrode 30*b* so that these two are separated, and is therefore always fixed irrespective of the flow conditions. There is therefore no possibility of the time required for completion of current interruption to be prolonged, as in the case of the conventional gas circuit breaker and it is possible to meet the demand for shortening the time for completion of current interruption.

(d) Reduction of the Drive Operating Force

The trigger electrode 31 is of smaller diameter than the fixed arc electrodes 30*a*, 30*b* and so can be made lighter in weight than the conventional movable arc electrode 4 and drive rod 6. Also, in addition to the two fixed arc electrodes 30*a*, 30*b*, the insulated nozzle 32 is not included in the movable section, so the weight of the movable section can be greatly reduced.

With this embodiment, in which the weight of the movable section is reduced in this way, the drive operating force that is necessary for current interruption, for obtaining the contacts-opening speed of the movable section, can be greatly reduced. Furthermore, since, in this embodiment, the cooling effect of the arc discharge 7 that is achieved by the low-temperature blast of pressurized gas 35 is very considerably raised, interruption of the arc discharge 7 can be achieved with a lower pressure, and this also contributes to reduction of the drive operating force.

Also, in this embodiment, a configuration is adopted in which the low-temperature pressurized gas 35 that is ejected from the inside of the fixed arc electrode 30*b* is directed so as to cut across transversely from the inside to the outside, being concentrated at the root of the arc discharge 7, which is located in the vicinity of the fixed arc electrode 30*b*. On the other hand, in the case of the conventional gas circuit breakers shown in FIG. 6A, FIG. 6B, FIG. 6C and FIG. 7A, FIG. 7B, FIG. 7C, the arc-extinguishing gas 1 is blown onto the arc discharge 7 from outside; in both of these conventional gas circuit breakers, the arc-extinguishing gas 1 flows along the longitudinal direction of the arc discharge 7.

When the arc-extinguishing gas 1 flows so as to cut across the root of the arc discharge 7, the heat loss of the arc in this region is greater than in the case where the arc-extinguishing gas 1 flows in the longitudinal direction with respect to the arc discharge 7. In order to achieve current interruption by lowering the electrical conductivity between the two arc electrodes 30*a*, 30*b*, it is not necessary that the entire arc discharge 7 should be cooled in all portions thereof, so long as the temperature is sufficiently lowered at some location thereof.

In accordance with this discovery, in this embodiment, an ideal construction for current interruption would be one in which low-temperature pressurized gas 35 flows so as to cut across the arc discharge 7 from the inside to the outside, being concentrated at the root of the arc discharge 7. With such an embodiment, it becomes possible to cut off the arc with an even lower pressure and therefore becomes possible to reduce the drive operating force while still maintaining excellent interruption performance.

Incidentally, it is known that the configuration of the flow of the arc-extinguishing gas 1 within the insulated nozzle has an extremely great influence on interruption performance. The insulated nozzle 8 in the conventional gas circuit breaker is incorporated in the movable section and is therefore driven during the current interruption action: thus the flow of the arc-extinguishing gas 1 within the insulated nozzle 8 fluctuates considerably depending for example on the stroke position on each occasion, and the speed of contacts-opening. It is therefore impossible to always achieve an ideal flow path shape in regard to the flow of the arc-extinguishing gas 1, over all current conditions.

In contrast, in the present embodiment, the insulated nozzle 32 and the arc electrodes 30*a*, 30*b* are all fixed. There can therefore be no relative change in position of these members; also, since no use at all is made of the self-pressurizing effect of the arc heat, the performance is always consistent, irrespective of the current conditions, irrespective of the pressure or flow rate of the pressurized gas 35 that is directed onto the arc discharge 7. It is therefore possible to design the flow path within the insulated nozzle 32 in an optimal fashion so as to be ideal in regard to arc interruption.

Also, the volume of the buffer chamber 36 on the left-hand side of the movable piston 33 expands with the contacts-opening drive, so hot exhaust gas 20 is sucked in from the arc discharge 7 and temporarily accumulated (buffered) therein, elevating the pressure in the buffer chamber 36. This pressure elevation provides a force pressing the movable piston 33 in the rightwards direction in FIG. 1A, FIG. 1B, FIG. 1C and this acts as a force that assists the drive operation of the movable section. Consequently, the drive operating force that is required for the drive operating mechanism can be reduced.

It should be noted that, although, if the aperture size of the exhaust hole 37 is increased, the rate of discharge of hot exhaust gas 20 is raised, on the other hand, scarcely any effect of pressure elevation of the buffer chamber 36 in assisting the drive operation can then be expected. However, even in this case, there is at least no action at all antagonistic to the drive operating force. Consequently, generation of hot exhaust gas 20 by the arc discharge 7 can reduce the drive operating force, compared with the case of a conventional gas circuit breaker, in which this hot exhaust gas invariably acts as a force opposing the drive operating force.

(e) Stability of the Gas Flow

Furthermore, in this embodiment, complex valve control for example adjusting the pressure within the compression puffer chamber 12 is unnecessary and furthermore the self-pressurizing action of the arc heating in elevating the blasting pressure of the arc-extinguishing gas 1 is not utilized. Consequently, the same gas blast pressure and stable gas flow rate can always be obtained irrespective of the current interruption conditions. As a result, instability of performance depending on the magnitude of the interruption current can never arise.

(f) Improved Interruption Performance in the Case of High-Speed Re-Closure Action Furthermore, since an inlet hole 17 and inlet valve 19 are provided in the compression puffer chamber 12 and the buffer chamber 36, if the pressure in these chambers becomes lower than the charging pressure in the sealed container, replenishment of the arc-extinguishing gas 1 is achieved by automatic intake thereof. The low-temperature arc-extinguishing gas 1 is therefore rapidly replenished in the compression puffer chamber 12 during closure action. Consequently, even in the case of a second interruption step in high-speed re-closure duty, there is no risk at all of degradation of interruption performance.

Thus, as described above, with this embodiment, all of the problems of a conventional gas circuit breaker can be simultaneously solved. Specifically, with this embodiment, a gas circuit breaker can be provided in which, by lowering the temperature of the gas blast and implementing a simple construction, the drive operating force can be greatly reduced and whereby stable flow of the arc-extinguishing gas can be achieved, and which also combines excellent interruption performance and durability.

(2) Second Embodiment

Construction

Figure 2A:
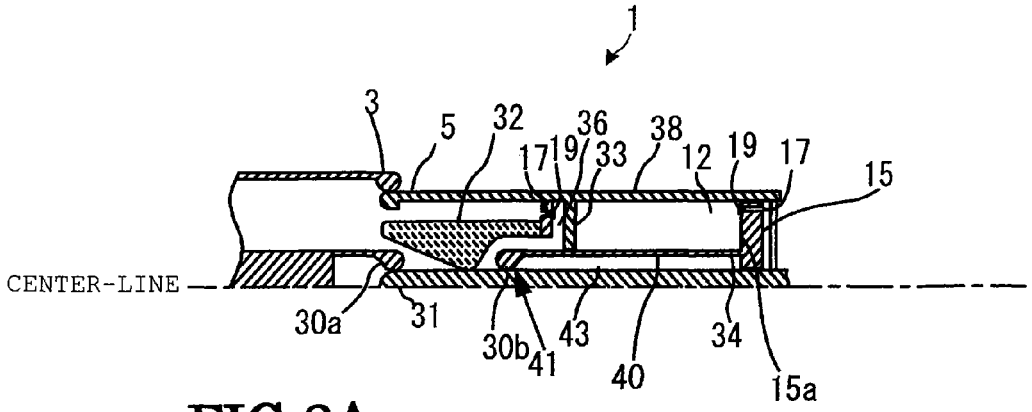
FIG. 2A, FIG. 2B and FIG. 2C are cross-sectional views showing the construction of a second embodiment.
Figure 2B:
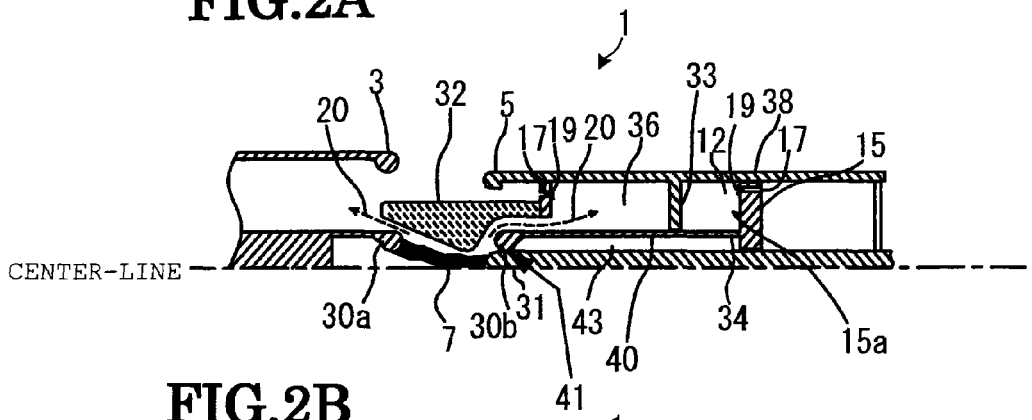
Figure 2C:
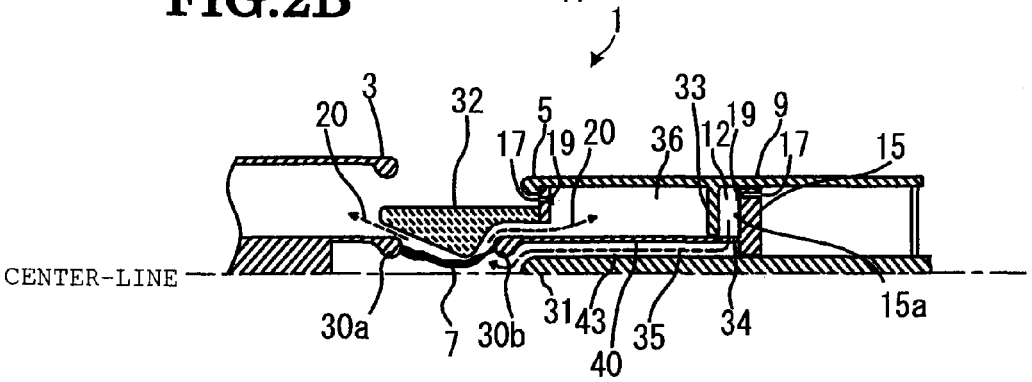

The construction of a second embodiment is described below with reference to FIG. 2A, FIG. 2B, and FIG. 2C. The main layout is the same as in the case of the first embodiment, so identical members are given the same reference numerals and further description thereof is dispensed with. This second embodiment has the characteristic feature that, instead of the puffer cylinder 9, it comprises a puffer cylinder 38 that is not provided with an exhaust hole 37 for the hot exhaust gas.

Beneficial Effect

In the second embodiment, by providing a puffer cylinder 38 that is not provided with an exhaust hole 37, the hot exhaust gas 20 that is generated by the arc discharge 20 flows into and is accumulated in the buffer chamber 36, greatly elevating the pressure of the buffer chamber 36. This pressure elevation acts as a force that assists the drive operation of the movable section, so the force that is required by the drive operating mechanism can be greatly reduced. In other words, the pressure elevation produced by the hot exhaust gas 20 from the arc discharge 7 can be positively transferred to drive operating force, making possible further reduction in the drive operating force.

This beneficial effect of reduction in the drive operating force is obtained to an outstanding degree in particular under large current interruption conditions. Specifically, the contacts-opening speed becomes higher as the interruption current becomes larger, thereby making it possible to achieve even more rapid arc interruption. Damage to the fixed arc electrodes 30*a*, 30*b* or insulated nozzle 32 can therefore be even further reduced.

It should be noted that, in order to raise the pressure of the buffer chamber 36, it would be possible to make the exhaust hole 37 for the hot exhaust gas 20 even smaller, but, in this case, the amount of hot exhaust gas 20 flowing from the space where the arc discharge 7 is generated is reduced, with the risk that heat exhaust performance may be degraded. It is therefore necessary to design the size of the exhaust hole 37 appropriately in a range such that the heat exhaust performance from the arc discharge 7 is not impaired.

(3) Third Embodiment

Construction

Figure 3A:
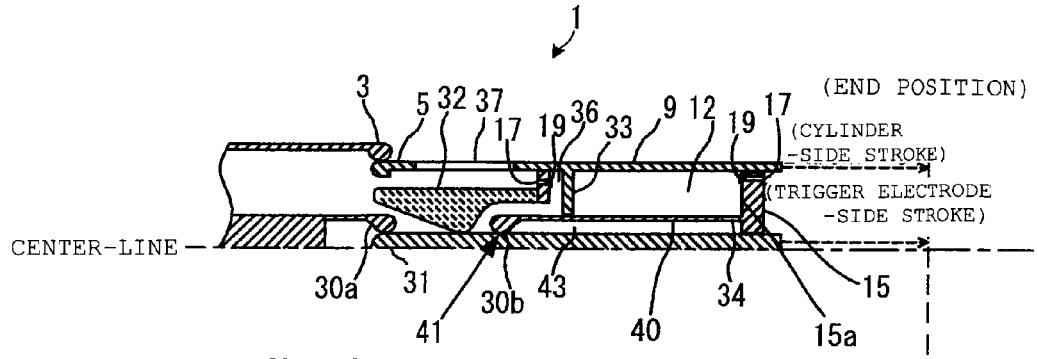
FIG. 3A, FIG. 3B and FIG. 3C are cross-sectional views showing the construction of a third embodiment.
Figure 3B:
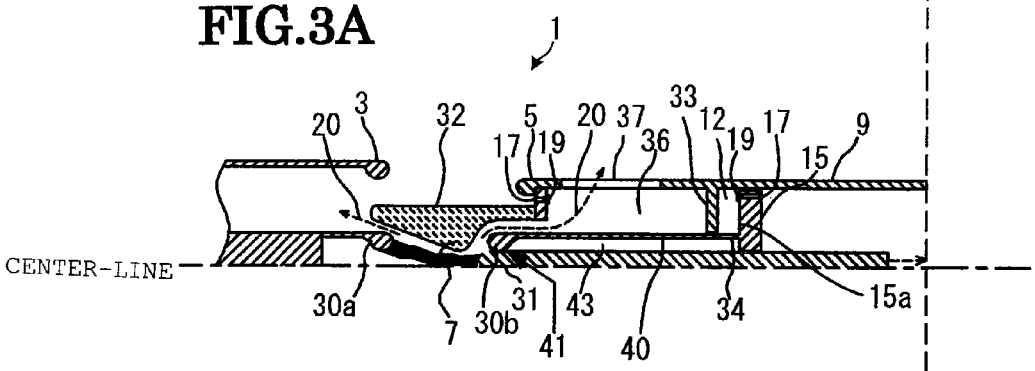
Figure 3C:
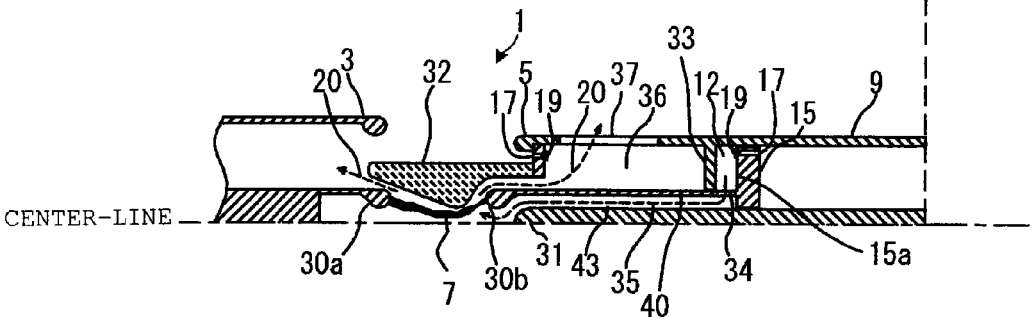

The construction of a third embodiment is described below with reference to FIG. 3A, FIG. 3B, and FIG. 3C. A characteristic feature of the third embodiment is that, while the puffer cylinder 9 and the movable piston 33 perform movement linked with the trigger electrode 31, the construction is such that both of these movements operate independently.

Consequently, the operating speed of the puffer cylinder 9 and the movable piston 33 and the operating speed of the trigger electrode 31 are arranged to be different, so that the construction is such that the puffer cylinder 9 and the movable piston 33 perform contacts-opening in advance of the trigger electrode 31. This construction, although not shown, can easily be implemented by for example a variable-speed link mechanism or the like.

Beneficial Effect

Figure 4:
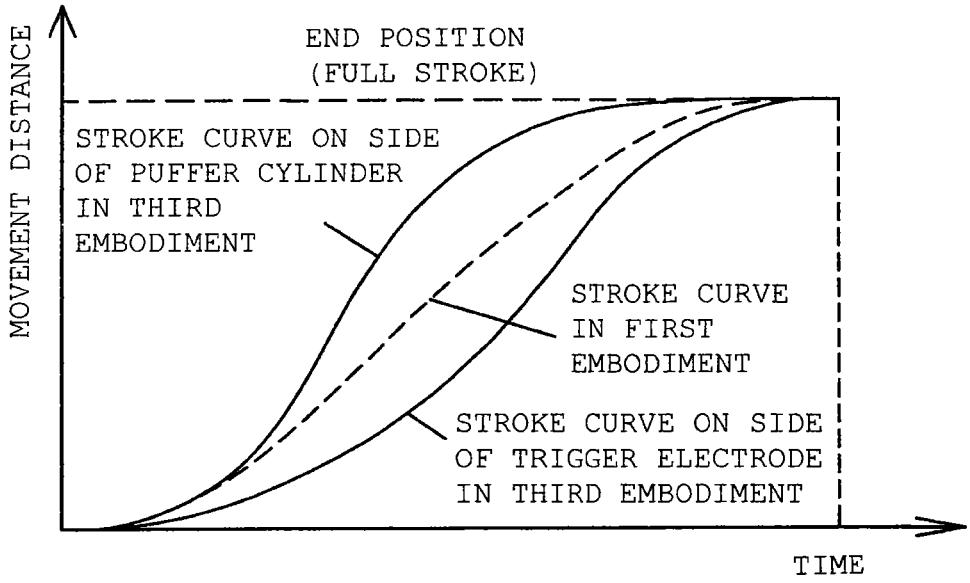
FIG. 4 is a graph showing an example of displacement of the trigger electrode and piston in the third embodiment.

With this third embodiment, in addition to the beneficial effects possessed by the embodiments described above, the following independent beneficial effect is achieved. This will be described with reference to FIG. 4. FIG. 4 shows an example of the displacement (operating stroke) of the puffer cylinder 9 and the movable piston 33 and the displacement of the trigger electrode 31.

In the first embodiment described above, the puffer cylinder 9, the movable piston 33 and trigger electrode 31 are integrally driven, so the two displacements in question of course follow the same curve. In contrast, in the third embodiment, the puffer cylinder 9 and movable piston 33 follow a displacement curve that is mutually independent of that of the trigger electrode 31.

As shown in FIG. 4, in the third embodiment, a construction is adopted whereby the puffer cylinder 9 and the movable piston 33 perform contacts-opening in advance of the trigger electrode 31, so, at the stage of initiation of the pressurized gas blast 35, in which the trigger electrode 31 passes the fixed arc electrode 30*b*, the arc-extinguishing gas 1 in the compression puffer chamber 12 is raised in pressure substantially to the final pressure.

Consequently, the amount of the hot exhaust gas 20 from the arc discharge 7 that flows back into the compression puffer chamber 12 is small, so, at the time-point where the pressurized gas blast 35 is initiated, a pressurized gas blast 35 of lower temperature can be achieved. It should be noted that the example shown in FIG. 4 is merely one example and various patterns of the operating strokes of the trigger electrode 31, puffer cylinder 9 and movable piston 33 may be considered.

For example, if importance is placed on a low-temperature compressed gas blast, as shown in FIG. 4, preferably it is arranged to perform contact-opening of the puffer cylinder 9 and movable piston 33 in advance of contact-opening of the trigger electrode 31. Contrariwise, if importance is placed on more rapid achievement of recovery of insulation between the electrodes, preferably it is arranged to perform contact-opening of the trigger electrode 31 in advance of contact-opening of the puffer cylinder 9 and movable piston 33.

The details of the setting of these contacts-opening timings are to be suitably determined in accordance with the design concept of the gas circuit breaker in question; however, in all cases, in this embodiment, the puffer cylinder 9 and movable piston 33 do not operate integrally with the trigger electrode 31, but are arranged to operate independently: in this way, a more flexible design can be achieved and further reduction in drive operating force can be achieved.

Thus, with the third embodiment constructed as above, just as in the case of the first and second embodiments, a considerable reduction in drive operating force can be achieved by a simple construction and a circuit breaker can be provided combining excellent interruption performance and durability. Furthermore, by arranging for the movable piston 33 and the trigger electrode 31 to be operated independently rather than to be operated integrally, more flexible design becomes possible and, in addition to the beneficial effects of the embodiments described above, a further reduction in drive operating force can be achieved.

(4) Fourth Embodiment

Construction

A characteristic feature of the fourth embodiment is the drive operating mechanism whereby compressive force is applied to the puffer piston 9. This drive operating mechanism is constructed so that the position of the puffer piston 9 is temporarily held in at least the final position, of the stroke performed by the puffer piston 9, so that the puffer piston 9 does not end up being moved backwards, in the opposite direction to the compressive force of the pressurized gas 35, by the pressure of the pressurized gas 35 in the compression puffer chamber 12. As the method of maintaining the position of the puffer piston 9, in for example the case where the drive operating mechanism is a hydraulic operating mechanism, there may be mentioned a method such as provision of a non-return valve at some point on the hydraulic circuit.

Beneficial Effect

As described above, in this embodiment, at the same time as the tip of the trigger electrode 31 passes the fixed arc electrode 30*b*, the pressurized gas 35 in the compression puffer chamber 12 that is compressed by the movable piston 33 is forcibly directed onto the arc discharge 7: in this way, excellent current interruption performance can be obtained.

However, in a gas circuit breaker for AC use, a current zero-point is encountered in each half cycle (for example 10 ms, in the case of a 50 Hz power delivery system), so achieving an arc time width at which interruption can be performed within at least a half cycle or somewhat more is demanded. In this embodiment, current interruption can be achieved from the stage in which the pressurized gas blast 35 is initiated by the tip of the trigger electrode 31 passing the fixed arc electrode 30*b*, but arc-extinguishing gas needs to be present in the compression puffer chamber 12 in a pressure and quantity that is fully sufficient for arc interruption at least at the current zero-point after a half cycle.

If a sufficient pressure and quantity of pressurized gas 35 is generated in the compression puffer chamber 12, the necessary compression time width can be achieved even if compression by the puffer piston 9 is not sustained for the half cycle. However, during this period, the pressure of the pressurized gas 35 acts on the movable piston 33 as a pressing-back force in the opposite direction to the direction of compression.

It is therefore necessary to hold the puffer piston 9 until the pressurized gas 35 in the compression puffer chamber 12 has passed through the blowout hole 34 and the pressurized gas through-flow space 43 to be discharged onto the arc discharge 7, thereby sufficiently lowering the pressure within the compression puffer chamber 12 so that the puffer piston 9 does not move backwards. This backwards movement of the puffer piston 9 can be suppressed for example by preventing backwards movement by adopting a method such as the provision of a non-return valve in the hydraulic circuit of the hydraulic operating mechanism.

With this fourth embodiment constructed as described above, in addition to the beneficial effects that the drive operating force can be greatly reduced by a simple construction and excellent interruption performance and durability can be achieved, since the position of the puffer piston 9 is temporarily maintained at least in the final position, the puffer piston 9 can be prevented from being moved backwards, in opposition to the direction of compression, by the pressure of the pressurized arc-extinguishing gas.

(5) Fifth Embodiment

Construction

The construction of a fifth embodiment will now be described with reference to FIG. 5A, FIG. 5B and FIG. 5C. In this fifth embodiment, an insulating puffer cylinder 44 made of insulating material is arranged on the inside of a puffer cylinder 38 that is not provided with an exhaust hole 37. The insulating puffer cylinder 44 is a cylindrical member of ring-shaped cross-section that is integrally constructed with the trigger electrode 31, movable powered electrode 5 and puffer cylinder 38.

A fixed piston 39 is arranged within the insulating puffer cylinder 44. The fixed piston 39 is fixed to the inside wall of a sealed container, not shown. The fixed piston 39 slides along the inside wall face of the insulating puffer cylinder 44 and divides the internal space of the insulating puffer cylinder 44 into two. In this fifth embodiment, in an arrangement that is the opposite of that of the first embodiment described above, the buffer chamber 36 is formed on the right-hand side of the fixed piston 39 and the compression puffer chamber 12 is formed on the left-hand side of the fixed piston 39. The fixed piston 39 is arranged so as to compress the arc-extinguishing gas 1 within the compression puffer chamber 12 by contacts-opening drive of the insulating puffer cylinder 44.

The compression puffer chamber 12 is constituted so as to be sealed until the contacts-opening position approaches the latter half of the contacts-opening process and in such a way as not to allow positive influx of hot exhaust gas 20 into the compression puffer chamber 12. Specifically, in the insulating puffer cylinder 44, a blowout hole 34 for the pressurized gas 35 is formed in the left-hand end section of the compression puffer chamber 12, which is on the left-hand side. The aperture face of the blowout hole 34 is provided in a position capable of contacting the outer circumferential section of the fixed arc electrode 30*a*. The aperture face of this blowout hole 34 constitutes an opening/closing section 41 in this fifth embodiment.

Also, the construction thereof is such that a gap through which hot exhaust gas 20 can flow is formed between the insulating puffer cylinder 44 and the cylindrical member 40. Furthermore, an inflow hole 45 for the hot exhaust gas 20 is formed in the vicinity of the end section on the right-hand side of the insulating puffer cylinder 44. The hot exhaust gas 20 flows into the interior of the buffer chamber 36 through this inflow hole 45.

Also, an inlet hole 17 and inlet valve 19 are provided in both end faces of the insulating puffer cylinder 44. The inlet hole 17 and inlet valve 19 are constructed so that intake replenishment of arc-extinguishing gas 1 is performed only when the internal pressure of the compression puffer chamber 12 and buffer chamber 36 is lower than the filling pressure within the sealed container. It should be noted that, in the fifth embodiment, the insulated nozzle 32 is dispensed with and the blowout hole 34 of the insulating puffer cylinder 44 performs the role of the flow-shaping means that guides the pressurized gas 35 onto the arc discharge 7.

In the fifth embodiment, the fixed arc electrode 30*b* and the cylindrical member 40 are integrally provided, but no sliding face 15*a* of the fixed piston 15 is provided at the end of the cylindrical member 40, so that, in the earlier half of the current interruption period, the end face of the insulating puffer cylinder 44 on the right-hand side in the Figure slides on the cylindrical member 40. Also, when the latter half of the current interruption period is reached, the end faces of the cylindrical member 14 and the insulating puffer cylinder 44 become separated. In this way, by separation of the end faces of the cylindrical member 14 and the insulating puffer cylinder 44, an exhaust hole 37 (shown in FIG. 5C) of the buffer chamber 36 is formed.

(Closure Condition)

Figure 5A:
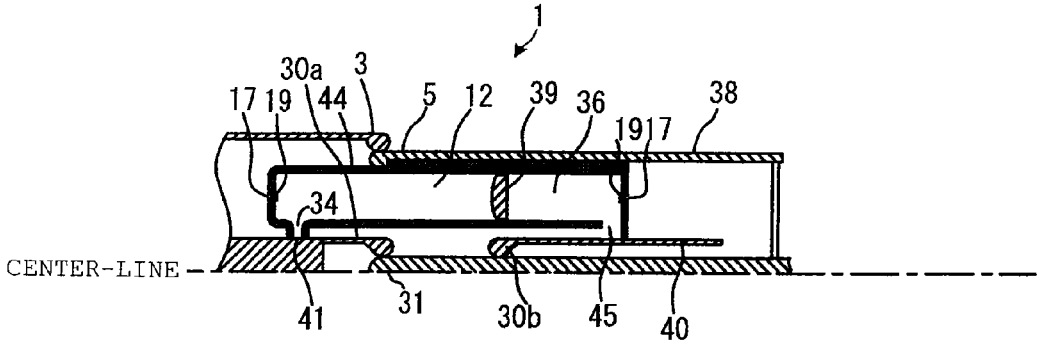
FIG. 5A, FIG. 5B and FIG. 5C are cross-sectional views showing the construction of a fifth embodiment.

In the closure condition of the fifth embodiment, just as in the first embodiment described above, the fixed arc electrode 30*a* and the fixed arc electrode 30*b* are in a separated condition and a conducting condition is achieved by the trigger electrode 31 short-circuiting the fixed arc electrodes 30*a*, 30*b* (condition of FIG. 5A).

(Current Interruption Action)

Figure 5B:
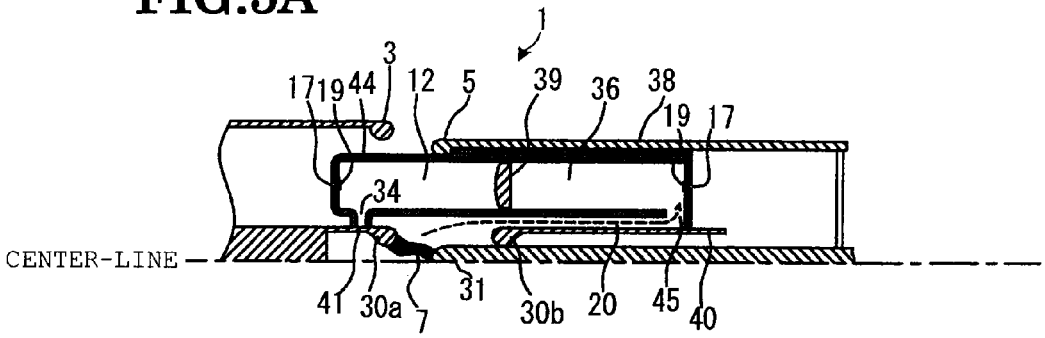
Figure 5C:
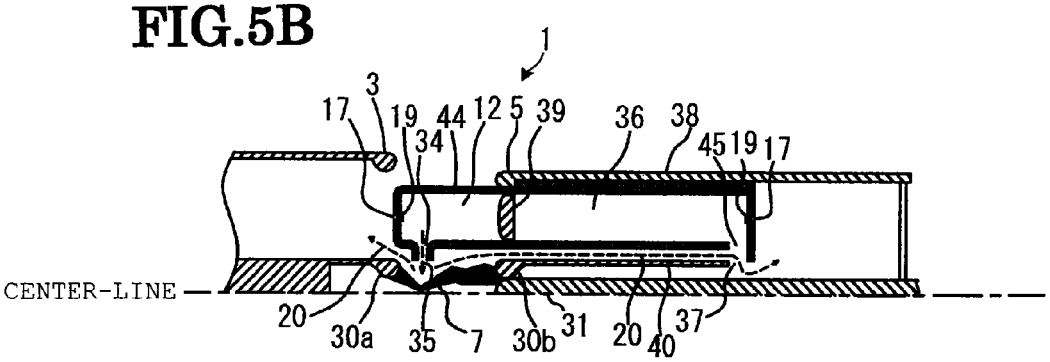
Figure 6A:
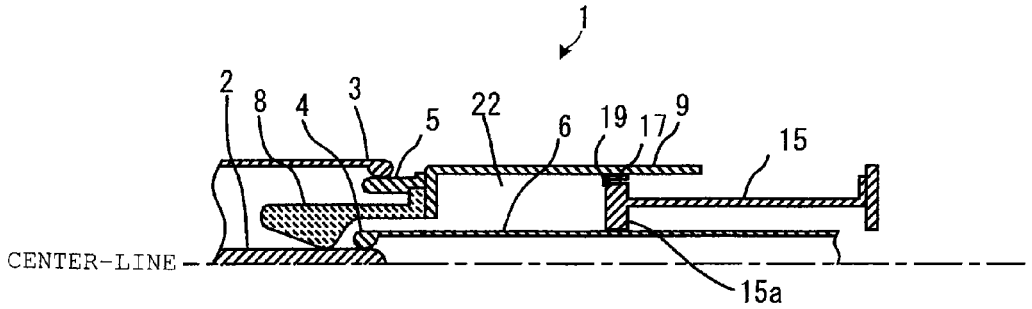
FIG.6A(PRIOR ART)
FIG. 6A, FIG. 6B and FIG. 6C are cross-sectional views showing the construction of a conventional puffer type gas circuit breaker.
Figure 6B:
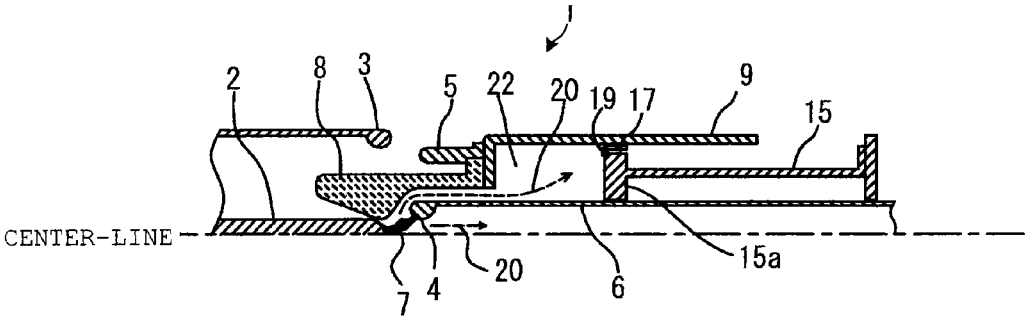
FIG.6B(PRIOR ART)
Figure 6C:
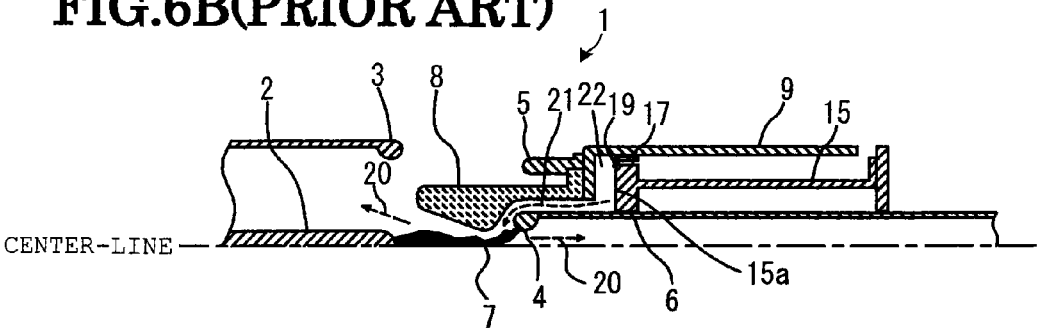
FIG.6C(PRIOR ART)
Figure 7A:
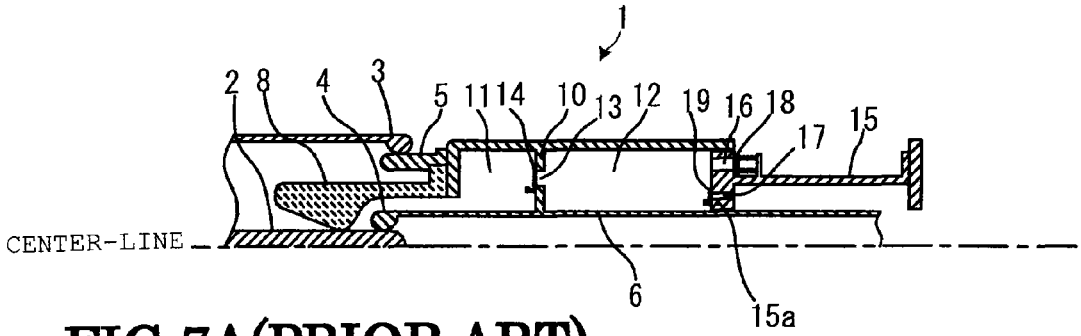
FIG.7A(PRIOR ART)
FIG. 7A, FIG. 7B and FIG. 7C are cross-sectional views showing the construction of a conventional series puffer type gas circuit breaker.
Figure 7B:
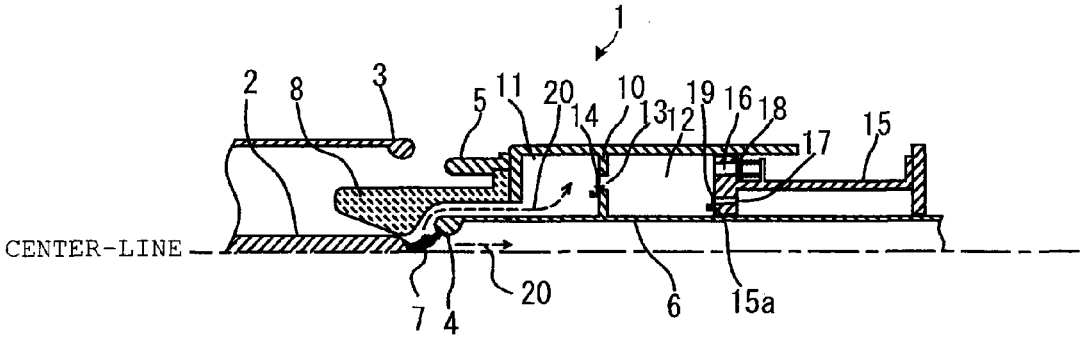
FIG.7B(PRIOR ART)
Figure 7C:
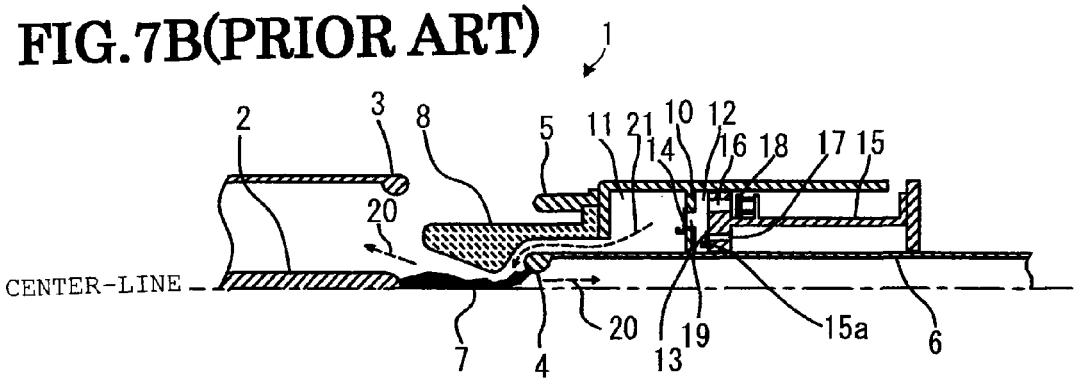
FIG.7C(PRIOR ART)

When performing a current interruption action according to the fifth embodiment, the puffer cylinder 38 and the insulating puffer cylinder 44 are made to perform contacts-opening drive in the rightwards direction in FIG. 5A, FIG. 5B and FIG. 5C, by means of the drive operating mechanism (not shown), causing the volume of the buffer chamber 36 on the right-hand side of the fixed piston 39 to be expanded with this contacts-opening action. Also, by means of the contacts-opening drive of the puffer cylinder 38 and the insulating cylinder 44 in the rightwards direction in FIG. 5A, FIG. 5B and FIG. 5C, the fixed piston 39 is caused to compress the arc-extinguishing gas 1 in the compression puffer chamber 12, thereby generating pressurized gas 35.

In the earlier half of the current interruption period, the end face on the right-hand side of the insulating puffer cylinder 44 in the Figure slides on the cylindrical member 40, allowing the hot exhaust gas that is generated by the arc discharge 7 to flow into the buffer chamber 36 from the inflow hole 45. The buffer chamber 36 therefore temporarily accumulates (buffers) hot gas 20 (condition of FIG. 5B).

Linked with the operation of the puffer cylinder 38 and the insulating puffer cylinder 44, the trigger electrode 31 is also driven in the contacts-opening direction i.e. the rightwards direction in FIG. 5A, FIG. 5B, FIG. 5C; when the trigger electrode 31 separates from the right-hand side fixed arc electrode 30*a* of FIG. 5A, FIG. 5B, FIG. 5C, an arc discharge 7 is ignited between the two electrodes 31 and 30*a* (condition of FIG. 5B). The period in which an arc discharge 7 is ignited at the trigger electrode 31 is exclusively the initial period of the interruption step, until the arc discharge 7 is migrated to the fixed arc electrode 30*b*.

At this time-point, the fixed arc electrode 30*a* and the aperture face of the blowout hole 34 of the insulating puffer cylinder 44 are adjoining. The contacting portion therefore constitutes an opening/closing section 41 and the compression puffer chamber 12 is put in a sealed condition (condition of FIG. 5A and FIG. 5B), apart from the gap which is unavoidable in view of the required sliding action of the fixed arc electrode 30*a* and the insulating puffer cylinder 44.

That is to say, thanks to the contact of the fixed arc electrode 30*a* and the aperture face of the blowout hole 34 of the insulating puffer cylinder 44, communication of the compression puffer chamber 12 and the space where the arc discharge 7 is generated is prevented; thus the aforementioned opening/closing section 41 is able to prevent entry of hot exhaust gas 20 into the compression puffer chamber 12, apart from the gap that is unavoidable in terms of operation of the fixed arc electrode 30*a* and the insulating puffer cylinder 44.

With further progress of the current interruption action, the arc discharge 7 is generated between the fixed arc electrode 30*a* and the trigger electrode 31 migrates from the trigger electrode 31 to the fixed arc electrode 30*b*, so that arc discharge 7 is generated between the fixed arc electrodes 30*a*, 30*b*. When the current interruption action approaches the latter half, the blowout hole 34 of the insulating puffer cylinder 44 passes the fixed arc electrode 30*a* and the aperture face of the blowout hole 34 of the insulating puffer cylinder 44 is separated from the fixed arc electrode 30*a*. In this way, the opening/closing section 41 changes from the closed condition to the open condition.

Also, with a timing that is about the same as the timing with which the opening/closing section 41 assumes the open condition, the end faces of the cylindrical member 40 and the insulating puffer cylinder 44 are separated, with the result that the exhaust hole 37 of the buffer chamber 36 is opened. At this point, the pressurized gas 35 that is directed onto the arc discharge 7 passes over the end face of the insulating puffer cylinder 44 and is discharged to the space within the sealed container (condition of FIG. 5C).

In this way, the blowout hole 34 can forcibly direct the low-temperature pressurized gas 35 in the compression puffer chamber 12 onto the arc discharge 7, thereby efficiently cooling and extinguishing the arc discharge 7 and so interrupting the current. Furthermore, the pressurized gas 35 in the compression puffer chamber 12 is injected into the vicinity of the end portion of the arc discharge 7 nearest the fixed arc electrode 30*a*, thereby making it possible to achieve more reliable extinction of the arc discharge 7.

(Beneficial Effect)

In the fifth embodiment as described above, with the contacts-opening drive of the insulating puffer cylinder 44, the fixed piston 39 generates high-pressure pressurized gas 35 within the compression puffer chamber 12. This pressure-elevating action enables low-temperature compressed gas to be generated, since the self-pressurizing action produced by arc heating is not utilized at all.

If the interruption current is small, the heat generated by the arc discharge 7 is small, so the pressure of the thermally expanding hot exhaust gas 20 is small. Since the volume of the buffer chamber 36 into which the hot exhaust gas 20 flows is expanded by drive of the insulating puffer cylinder 44, there is therefore a possibility of the pressure in this portion becoming a negative pressure. If this happens, rapid replenishment of the buffer chamber 36 with arc-extinguishing gas 1 is effected from the inlet valve 19 and the inlet hole 17 so as to suppress generation of drive reaction produced by negative pressure in this portion.

In contrast, if the interruption current is large, the pressure of the hot exhaust gas 20 acts on the wall surface on the side of the insulating puffer cylinder 44 nearer to the inflow hole 45 i.e. it can act as drive force of the insulating puffer cylinder 44. Also, since, in this fifth embodiment, the insulating puffer cylinder 44 is made of insulating material, even though it is present between the electrodes in the contacts-opening condition, it does not threaten to degrade the electrical insulation performance.

As described above, with this fifth embodiment, the compression of the pressurized gas 35 that is directed onto the arc discharge 7 is performed entirely by mechanical compression, so hot exhaust gas 20 that is thermally expanded by the heat of the arc discharge 7 does not flow into the compression puffer chamber 12. Furthermore, the pressure of the hot exhaust gas 20 can act as a force assisting the drive operation. Consequently, the drive operating force can be greatly reduced by a simple construction and a gas circuit breaker can be provided that combines excellent interruption performance and durability. Thus, with this fifth embodiment also, exactly the same beneficial effects as the beneficial effects described with reference to the first embodiment can be obtained.

(6) Other Embodiments

The most important points in the construction of the embodiments described above are that compression of the arc-extinguishing gas 1 i.e. the pressurized gas 35 that is directed onto the arc discharge 7 is effected chiefly by mechanical compression, and the arc-extinguishing gas 1 i.e. the hot exhaust gas 20 that is thermally expanded by the heat of the arc discharge 7 is positively prevented from flowing into the pressure-accumulation space constituted by the compression puffer chamber 12. Also, a structurally important point is that a construction is adopted whereby the pressure of the arc-extinguishing gas 1 that is thermally expanded by the heat of the arc discharge 7 does not act as a drive operation reaction on the movable section of the gas circuit breaker, but can act as a force assisting the drive operation.

While the above embodiments have the above characteristic features, these are merely presented in this specification as examples and are not intended to restrict the scope of the invention. Specifically, the invention could be put into practice in various other modes and various omissions, substitutions or alterations could be performed within a range not departing from the scope of the invention. Such embodiments or modifications are included in the gist of the invention and likewise included in the scope of the invention set forth in the patent claims and in the scope of equivalents thereof.

What is claimed is:

1. A gas circuit breaker constituted by oppositely arranging a pair of arc electrodes in a sealed container filled with arc-extinguishing gas, said arc electrodes being constructed so that said arc electrodes are capable of electrical conduction and are capable of generating arc discharge between said arc electrodes during current interruption, said gas circuit breaker comprising:

a pressurizing means in order to direct arc-extinguishing gas onto said arc discharge, for generating pressurized gas by elevating a pressure of said arc-extinguishing gas;

a pressure-accumulation space that accumulates said pressurized gas;

a flow-shaping means for directing said pressurized gas toward said arc discharge from said pressure accumulation space; and an opening/closing section that can be freely opened/closed, provided in order to produce a closed condition or open condition of said pressure-accumulation space, wherein said pair of arc electrodes are fixed within said sealed container;

a trigger electrode that is of smaller diameter than said arc electrodes is freely and movably arranged between said arc electrodes on an inside of said pair of arc electrodes;

said trigger electrode produces a conducting condition by short-circuiting said pair of arc electrodes by coming into contact with said pair of arc electrodes, an arc discharge is generated between said trigger electrode and one of said arc electrodes during current interruption, and an arrangement is such that said arc discharge finally migrates to another said arc electrode from said trigger electrode; and said opening/closing section is constituted of a gap portion of said trigger electrode and said arc electrode on the side to which said arc discharge is finally migrated from said trigger electrode.

2. The gas circuit breaker according to claim 1, wherein said pressurization means comprises:;

a movable puffer cylinder;

a movable piston provided integrally with said puffer cylinder; and a fixed piston that is arranged in a freely slidable fashion within said puffer cylinder, facing said movable piston, and is fixed within said sealed container.

3. The gas circuit breaker according to claim 2, wherein a pressure of a hot exhaust gas that is generated by a heat of said arc discharge does not act as an opposing force when said arc-extinguishing gas within said puffer cylinder is compressed.

4. The gas circuit breaker according to claim 2, wherein a hot exhaust gas accumulation space is formed that is provided in order to temporarily accumulate hot exhaust gas generated by said heat of said arc discharge.

5. The gas circuit breaker according to claim 4, wherein said hot exhaust gas accumulation space is formed with an exhaust hole to allow said hot exhaust gas to escape outside this hot exhaust gas.

6. The gas circuit breaker according to claim 4, wherein a pressure in said hot exhaust gas accumulation space acts as a force assisting compression of said arc extinguishing gas within said puffer cylinder.

7. The gas circuit breaker according to claim 1, constructed so that said pressurized gas is directed into a vicinity of an end portion of said arc discharge.

8. The gas circuit breaker according to claim 1, wherein said opening/closing section is constituted so that said opening/closing section is in a closed condition in an earlier half of a current interruption period, in which said opening/closing section prevents inflow of hot exhaust gas generated by a heat of said arc discharge into said pressure-accumulation space, or outflow of said pressurized gas within said pressure-accumulation space during pressurization, and is in an open condition in a latter half of said current interruption period, so as to direct said pressurized gas in said pressure-accumulation space onto said arc discharge.

9. The gas circuit breaker according to claim 8, constructed so that said pressurized gas is directed into a vicinity of an end portion of said arc discharge.

10. The gas circuit breaker according to claim 8, wherein said pressurization means comprises:

a movable puffer cylinder;

a moveable piston provided integrally with said puffer cylinder; and a fixed piston that is arranged in a freely slidable fashion within said puffer cylinder, facing said moveable piston, and is fixed within said sealed container.

11. A gas circuit breaker constituted by oppositely arranging a pair of arc electrodes in a sealed container filled with arc-extinguishing gas, said arc electrodes being constructed so that said arc electrodes are capable of electrical conduction and are capable of generating arc discharge between said arc electrodes during current interruption, said gas circuit breaker comprising:

a pressurizing means in order to direct arc-extinguishing gas onto said arc discharge, for generating pressurized gas by elevating a pressure of said arc-extinguishing gas;

a pressure-accumulation space that accumulates said pressurized gas;

a flow-shaping means for directing said pressurized gas toward said arc discharge from said pressure-accumulation space;

an opening/closing section that can be freely opened/closed, provided in order to produce a closed condition or open condition of said pressure-accumulation space; and a hot exhaust gas accumulation space provided in order to temporarily accumulate hot exhaust gas generated by a heat of said arc discharge;

wherein said pressurizing means includes:

a freely movable puffer cylinder;

an insulating puffer cylinder made of insulating material provided integrally with said puffer cylinder; and a fixed piston fixed within said sealed container and arranged in a freely slidable fashion within said insulating puffer cylinder;

wherein an internal space of said insulating puffer cylinder is divided into said pressure accumulation space and said hot exhaust gas accumulation space by said fixed piston; and in said insulating puffer cylinder, there is provided an inflow hole for intake of said hot exhaust gas into said hot exhaust gas accumulation space, on a side of said hot exhaust gas accumulation space, and said opening/closing section is provided on a side of said pressure-accumulation space.

12. The gas circuit breaker according to claim 11, wherein said opening/closing section is initially in closed condition in an earlier half of a current interruption period, in which said opening/closing section prevents inflow of hot exhaust gas generated by a heat of said arc discharge into said pressure-accumulation space, or outflow of said pressurized gas within said pressure-accumulation space during pressurization, and is in an open condition in a latter half of said current interruption period, so as to direct said pressurized gas in said pressure-accumulation space onto said arc discharge.

13. The gas circuit breaker according to claim 12, wherein said pair of arc electrodes is fixed in said sealed container;

a trigger electrode of diameter smaller than said pair of arc electrodes is freely and movably arranged between said arc electrodes on an inside of said pair of arc electrodes; and said trigger electrode produces a conducting condition by short-circuiting said pair of arc electrodes by coming into contact with said pair of arc electrodes, an arc discharge is generated between said trigger electrode and one of said arc electrodes during current interruption, and an arrangement is such that said arc discharge finally migrates to another said arc electrode from said trigger electrode, wherein said opening/closing section of said insulating puffer cylinder is constituted of a gap portion of said insulating puffer cylinder and said arc electrode on a side where said arc discharge is initially generated, between said arc electrode and said trigger electrode.

14. The gas circuit breaker according to claim 11, wherein said pair of arc electrodes is fixed in said sealed container;

a trigger electrode of diameter smaller than said pair of arc electrodes is freely and movably arranged between said arc electrodes on an inside of said pair of arc electrodes; and said trigger electrode produces a conducting condition by short-circuiting said pair of arc electrodes by coming into contact with said pair of arc electrodes, an arc discharge is generated between said trigger electrode and one of said arc electrodes during current interruption, and an arrangement is such that said arc discharge finally migrates to another said arc electrode from said trigger electrode, wherein said opening/closing section of said insulating puffer cylinder is constituted of a gap portion of said insulating puffer cylinder and said arc electrode on a side where said arc discharge is initially generated, between said arc electrode and said trigger electrode.

15. The gas circuit breaker according to claim 14, constructed so that said pressurized gas is directed into a vicinity of an end portion of said arc discharge.

* * * * *